US007252071B2

(12) United States Patent
Kochanowski et al.

(10) Patent No.: US 7,252,071 B2
(45) Date of Patent: Aug. 7, 2007

(54) FUEL RAIL

(75) Inventors: George E. Kochanowski, Springboro, OH (US); Sam A. Sked, Dayton, OH (US); Robert G. Farrell, Franklin, OH (US)

(73) Assignee: Delaware Capital Formation, Inc., Wilmington, DE (US)

( * ) Notice: Subject to any disclaimer, the term of this patent is extended or adjusted under 35 U.S.C. 154(b) by 122 days.

(21) Appl. No.: 11/093,829

(22) Filed: Mar. 30, 2005

(65) Prior Publication Data

US 2006/0225705 A1 Oct. 12, 2006

(51) Int. Cl.
*F02M 55/02* (2006.01)
*F02M 69/46* (2006.01)

(52) U.S. Cl. ..... 123/456; 123/468

(58) Field of Classification Search ..... 123/456, 123/468, 469, 470

See application file for complete search history.

(56) References Cited

U.S. PATENT DOCUMENTS

| | | | | | |
|---|---|---|---|---|---|
| 4,601,275 | A | * | 7/1986 | Weinand | 123/468 |
| 4,756,289 | A | * | 7/1988 | Rock et al. | 123/463 |
| 4,776,313 | A | * | 10/1988 | Freismuth et al. | 123/470 |
| 4,938,909 | A | * | 7/1990 | Daly | 264/219 |
| 5,022,371 | A | * | 6/1991 | Daly | 123/468 |
| 5,086,743 | A | * | 2/1992 | Hickey | 123/468 |
| 5,146,896 | A | * | 9/1992 | Imoehl et al. | 123/470 |
| 5,163,406 | A | | 11/1992 | Daly et al. | |
| 5,168,856 | A | * | 12/1992 | Lorraine | 123/468 |
| 5,170,011 | A | | 12/1992 | Martucci | |
| 5,197,435 | A | * | 3/1993 | Mazur et al. | 123/456 |
| 5,611,313 | A | | 3/1997 | Ashcraft | |
| 5,681,518 | A | | 10/1997 | Ashcraft | |
| 5,735,247 | A | | 4/1998 | Tsuzuki et al. | |
| 5,849,229 | A | | 12/1998 | Holtzberg | |
| 6,067,480 | A | | 5/2000 | Stuffle et al. | |
| 6,103,156 | A | | 8/2000 | Holtzberg | |
| 6,148,798 | A | | 11/2000 | Braun et al. | |
| 6,227,170 | B1 | | 5/2001 | Koshiba | |
| 6,269,804 | B1 | | 8/2001 | Braun et al. | |
| 6,344,160 | B1 | | 2/2002 | Holtzberg | |
| 6,564,775 | B1 | | 5/2003 | Kikuta et al. | |
| 6,626,152 | B1 | | 9/2003 | Deangelis et al. | |
| 6,640,783 | B2 | | 11/2003 | Braun et al. | |
| 6,802,297 | B2 | | 10/2004 | Braun et al. | |
| 2002/0108660 | A1 | | 8/2002 | Braun et al. | |

FOREIGN PATENT DOCUMENTS

| | | |
|---|---|---|
| DE | 103 20 953 | 12/2004 |
| EP | 1 233 174 | 8/2002 |
| EP | 1 457 663 | 9/2004 |

* cited by examiner

*Primary Examiner*—Thomas Moulis
(74) *Attorney, Agent, or Firm*—Brooks & Cameron, PLLC

(57) ABSTRACT

Embodiments include a fuel rail and method for making the fuel rail. Embodiments of the fuel rail include an elongate tubular body with a wall defining a lumen, the elongate tubular body formed with a thermoset composite material, and a pressure port having a lumen in fluid communication with the lumen of the elongate tubular body.

28 Claims, 7 Drawing Sheets

FUEL RAIL

INTRODUCTION

Fuel rails are elongate conduits for delivering fuel in an engine's fuel injection system. Fuel rails typically operate under high fluid pressure in order to deliver a sufficient quantity of fuel to the engine. Some engines, such as diesel engines, require a higher fluid pressure in order to properly deliver the fuel to the fuel injection system of the diesel engine.

Fuel rails that operate under high fluid pressure are typically made from metal. While fuel rails made of metal are able to withstand high fluid pressure, they are generally heavy and are costly to manufacture. For example, metal fuel rails have many components and thus, the number of manufacturing steps to assemble metal fuel rails can increase assembly time and related costs.

BRIEF DESCRIPTION OF THE DRAWINGS

The images provided in the figures are not necessarily to scale. In addition, some images in the figures may have been enlarger relative other figures to help show detail.

DETAILED DESCRIPTION

Figure 1A:
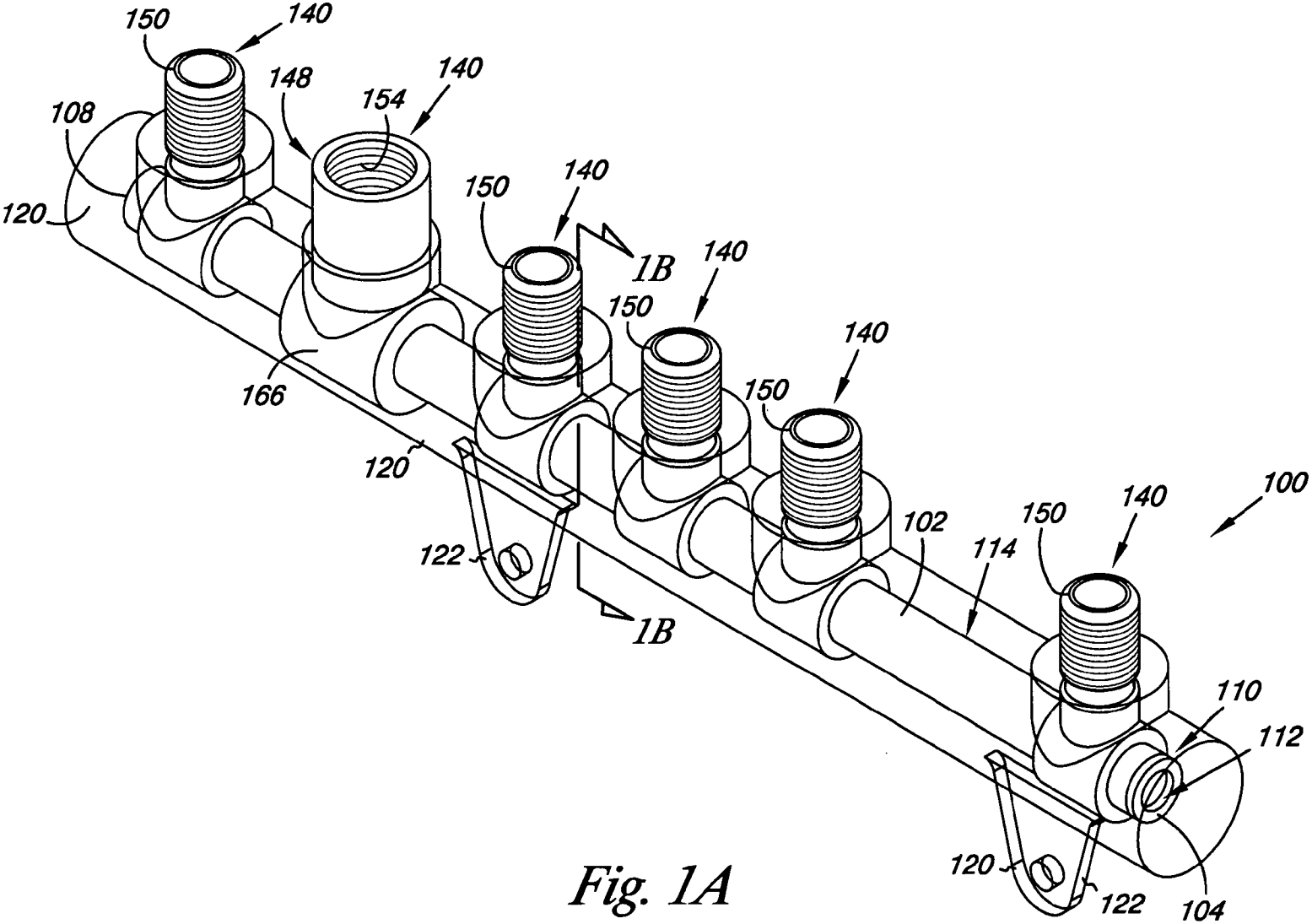
FIG. 1A illustrates an embodiment of a fuel rail of the present invention.

Embodiments of the present invention are directed to fuel rail components, fuel rails, and methods for forming the fuel rail and its components formed with a thermoset composite material or other suitable material.

As will be described herein, a fuel rail includes an elongate tubular body having a wall defining a lumen extending there through. In the embodiments described in the present disclosure, the elongate tubular body is formed with a thermoset composite material. As used herein, a thermoset composite material includes those polymeric materials that once shaped by curative methodology so as to form a cross-linked polymeric matrix are incapable of being reprocessed by further application of heat and pressure.

The fuel rail also includes a pressure port having a lumen. The lumen of the pressure port is in fluid communication with the lumen of the elongate tubular body. In some embodiments, pressure ports can be formed integrally with the wall of the elongate tubular body. In other embodiments, the pressure port is a separate component having a collar that can be coupled to the elongate tubular body, where the collar at least partially, or completely, encircles the elongate tubular body. In various embodiments, components of a fuel injector can be coupled to the pressure port to allow for injecting fuel into the cylinder of an engine.

Some embodiments the fuel rail also include an over molding of the elongate tubular body and at least a portion of the pressure port. The over molding can be formed with a thermoset composite material that is either the same or different than the thermoset composite material used in the elongate tubular body. In various embodiments, the thermoset of the over molding can also be used to form one or more mounting structures for allowing the fuel rail to be attached to an engine. Examples of such engines include, but are not limited to, diesel and gasoline engines.

According to various embodiments, the fuel rail includes various components formed with thermoset composite materials that can provide strength and rigidity to the fuel rail relative to conventional metal fuel rails. Moreover, the fuel rail of the present embodiments can be lighter in weight and thus, may benefit the fuel efficiency of an engine in which the fuel rail is attached. Finally, fuel rails formed with plastic typically have more component parts relative to their metal counterparts, but the weight and cost of the plastic fuel rail assembly, due to a reduction in the required machining of the metal fuel rail, may be reduced.

The figures herein follow a numbering convention in which the first digit or digits correspond to the drawing figure number and the remaining digits identify an element in the drawing. Similar elements between different figures may be identified by the use of similar digits. For example, 102 may reference element "102" in FIG. 1A, and a similar element may be referenced as "202" in FIG. 2A. As will be appreciated, elements shown in the various embodiments herein can be added, exchanged, and/or eliminated so as to provide a number of additional embodiments. In addition, discussion of features and/or attributes for an element with respect to one figure can also apply to the element shown in one or more additional figures.

Figure 1B:
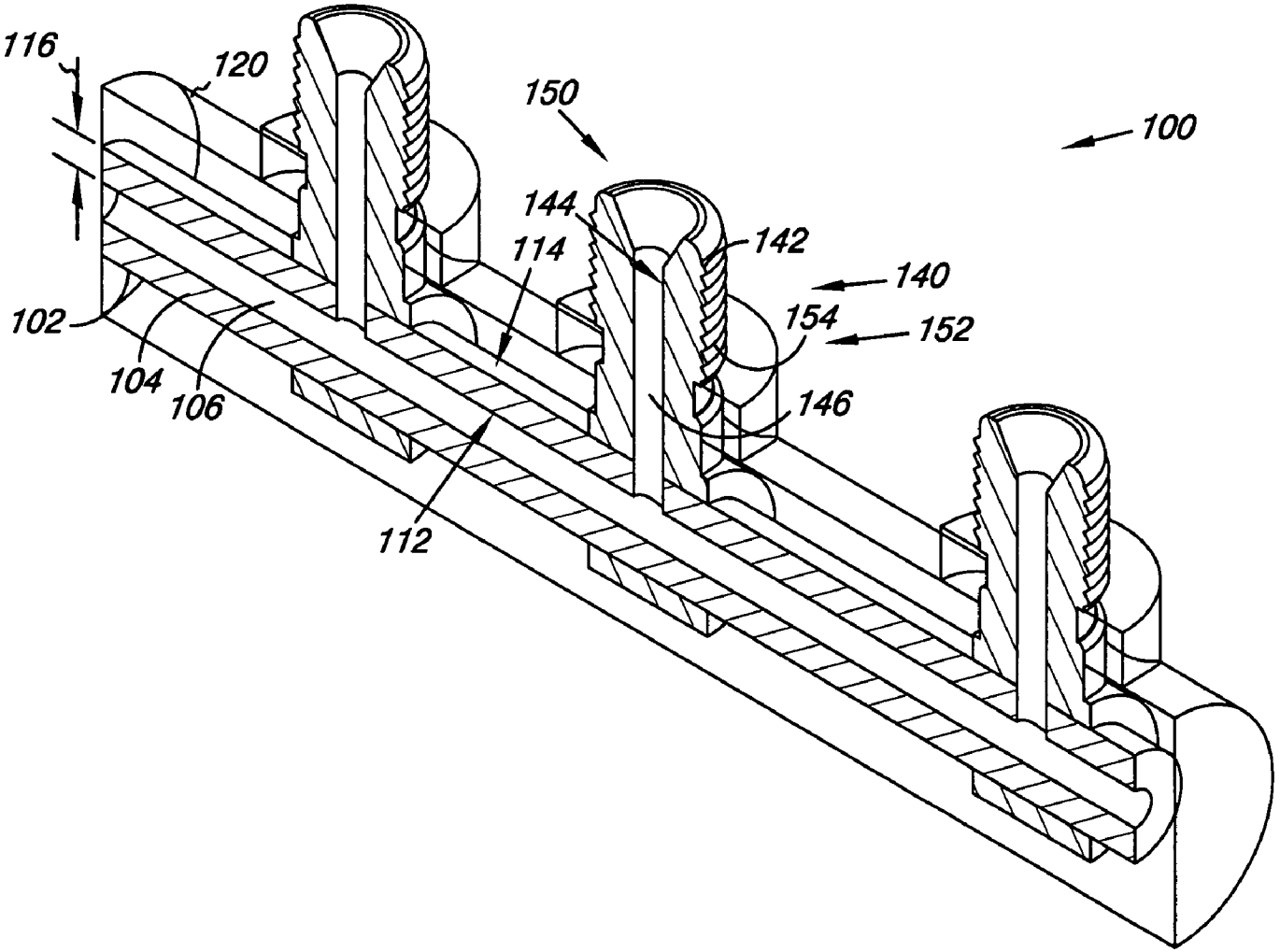
FIG. 1B is a cross-sectional view of the fuel rail of FIG. 1A take along lines 1B-1B.

The figures presented herein provided illustrations of non-limiting example embodiments of the present invention. For example, FIGS. 1A and 1B provides an illustration of one embodiment of a fuel rail 100. As shown in FIGS. 1A and 1B, the fuel rail 100 includes an elongate tubular body 102 having a wall 104 defining a lumen 106. The lumen 106 extends between a first end 108 and a second end 110 of the elongate tubular body 102.

The wall 104 of the elongate tubular body 102 includes an inner surface 112 and an outer surface 114. In various embodiments, the inner and outer surfaces 112 and 114 respectively, can be formed to provide various functionalities to the fuel rail 100. For example, in some embodiments, the inner surface 112 of the elongate tubular body 102 can be formed to include a smooth surface to facilitate a fluid flow that delivers pressurized fluid to components attached to the fuel rail 100 and to reduce a tendency of the fluid to experience turbulence and cavitations due to high fluid pressure within the fuel rail 100.

The lumen 106 of the elongate tubular body 102 can have various cross-sectional shapes. For example, the inner surface 112 of the elongate tubular body 102 can define a circular, an oval, a polygonal (e.g., triangular, square, etc.), and/or a semi-polygonal cross-sectional shape. In various embodiments, the elongate tubular body 102 of fuel rail 100 can be designed such that it includes a particular cross-sectional geometry such that the inner surface 112 does not promote cavitation of the pressurized fluid flowing in the lumen 106.

In addition, the cross-sectional shape defined by the inner surface 112 can vary along the length of the lumen 106. So, for example, the lumen 106 can have a circular cross-section along one or more regions of the inner surface 112 and an oval cross-section along one or more other regions of the inner surface 112. In other words, cross-sectional shapes of the lumen 106 can, for example, provide for a elongate tubular body 102 of the fuel rail 100 having similar and/or different cross-sectional geometries along its length. The similarities and/or differences in the cross-sectional geometries can be based on one or more desired functions to be elicited from the elongate tubular body 102 (e.g., tuning of the fuel rail 100 and/or reduction/elimination of cavitation and turbulence).

As will be appreciated, the elongate tubular body 102 can also have various lengths and outer dimensions (e.g., diameters) that will be determined based on the application of the fuel rail 100. In addition, the outer surface 114 of the elongate tubular body 102 can have various cross-sectional shapes. For example, the outer surface 114 can define a circular, an oval, a polygonal (e.g., triangular, square, etc.), and/or a semi-polygonal cross-sectional shape. In addition, the distance 116 between the inner surface 112 and the outer surface 114 of the elongate tubular body 102 can either remain essentially the same or vary between the first end 108 and the second end 110 of the elongate tubular body 102.

The fuel rail 100 further includes an overmold layer 120 at least partially surrounding the elongate tubular body 102. As illustrated, the overmold layer 120 includes one or more attachment members 122 that allow the fuel rail 100 to be secured to an engine. In one embodiment, the one or more attachment members 122 are integral with (i.e., formed from the same material and during the same molding process) as the over molded layer 120.

Alternatively, the one or more attachment members 122 can be a separate piece that is at least partially, or completely, encased in the overmold layer 120. In addition, the one or more attachment members 122 configured as a separate piece can be mechanically or chemically coupled to the overmold layer 120. Examples include the use of fasteners such as bands, a threaded engagement, and/or adhesives. When configured as a separate piece, the attachment member can be made of a metal, metal alloy, or polymer (e.g., thermoplastic and/or thermoset composite with or without reinforcements and/or additives) depending upon the nature of the application for the fuel rail 100.

As will be more fully discussed herein, the overmold layer 120 can serve additional functions with respect to the fuel rail 100. For example, the overmold layer 120 can serve to secure one or more pressure ports 140 to the elongate tubular body 102. Alternatively, the overmold layer 120 can serve to form at least a portion of the one or more pressure ports 140. In addition, the overmold layer 120 helps to occlude (i.e., plug) the first and second ends 108 and 110 of the elongate tubular body 102. Alternatively, a separate plug can be secured in the lumen 106 at the first end 108 and the second end 110 of the elongate tubular body 102 prior to receiving the overmold layer 120.

As illustrated in FIGS. 1A and 1B, the fuel rail 100 includes one or more pressure ports 140. In one embodiment, the pressure ports 140 are spaced along the elongate tubular body 102 and extend radially away from the center of the elongate tubular body 102. The pressure ports 140 include a wall 142 having a surface 144 defining a lumen 146. The lumen 146 is in fluid communication with the lumen 106 of the elongate tubular body 102.

As will be appreciated, the pressure ports 140 also provide for a connection to be established between the fuel rail 100 and other components (e.g., a fuel injector and a feed line of a fuel injector pressure pump) of a fuel injection system. As illustrated, the pressure ports 140 can include an inlet port 148 for supplying the liquid fuel to the fuel rail 100 and outlet ports 150 for delivering fluid from the fuel rail 100.

A number of pressure ports 140 can be provided for the fuel rail 100 to accommodate the requirements of an engine to which the fuel rail 100 is attached. As will be appreciated, the number of pressure ports can depend on the type of fuel injection system used and/or the number of cylinders in the engine in which the fuel rail is used. In addition, it is possible that the fuel rail 100 can include outlet ports 148 as illustrated, while the fluid inlet can take place into an end of the elongate tubular body 102, as for example, the first and/or the second ends 108 and 110.

As will be appreciated, a thermoplastic could be used as the overmold layer 120, besides other portions of the fuel rail 100. By way of example, thermoplastics can include, but are not limited to, polyolefins such as polyethylene and polypropylene, polyesters such as Dacron, polyethylene terephthalate and polybutylene terephthalate, vinyl halide polymers such as polyvinyl chloride (PVC), polyacetal, polyvinylacetate such as ethyl vinyl acetate (EVA), polyurethanes, polymethylmethacrylate, pellethane, polyamides such as nylon 4, nylon 6, nylon 66, nylon 610, nylon 11, nylon 12 and polycaprolactam, polyaramids (e.g., KEVLAR), styrenes, polystyrene-polyisobutylene-polystyrene (SIBS), segmented poly(carbonate-urethane), Rayon, fluoropolymers such as polytetrafluoroethylene (PTFE or TFE) or expanded polytetrafluoroethylene (ePTFE), ethylene-chlorofluoroethylene (ECTFE), fluorinated ethylene propylene (FEP), polychlorotrifluoroethylene (PCTFE), polyvinylfluoride (PVF), polyvinylidenefluoride (PVDF), polyetheretherketone (PEEK), polysulphone, polyphenylene sulfide, polycarbonate, acrylic-styrene, acrylonitrile butadiene, polyphenylene oxide, polybutadiene terephthalate, polyphenylene sulphide, and polyphenylenesulphone. Other suitable thermoplastics are also possible.

FIGS. 1A and 1B further illustrates an embodiment of the pressure ports 140 that include a connector 152 for releasably connecting components of the fuel injection system, as discussed herein, to the pressure ports 140. As illustrated, the connector 152 can include a threaded portion 154 of the pressure ports 140 that allows for a fluid tight connection to be made between the fuel rail 100 and the additional components of the fuel injection system. In various embodiments, the threaded portion 154 can be positioned on an inner surface of the pressure port 140, e.g., a female thread, or an outer surface of the pressure port 140, e.g., a male thread. Embodiments are not, however, limited to the use of threads for attaching components to the pressure ports 140.

As will be appreciated, other ways of establishing a fluid tight releasable connection to the fuel injection system exist. For example, a releasable connection can be formed with a concentric a quick release collar mechanism that engages a flare or recess on the connector 152. Other connection mechanisms are possible.

In addition, the fuel rail embodiments described herein can include various types of fuel rails such as return type fuel rails and returnless type fuel rails. A return type fuel rail can include other components such as crossover pipes that provide fluid transfer between two or more fuel rails, and return pipes that provide for the return of excess fuel not consumed by an the engine to a fuel tank. Returnless type fuel rails do not return fuel to a fuel tank. Such fuel rails operate at a higher pressure than return type fuel rails and deliver all the fuel that enters the fuel rail to the intake manifold of an engine.

In various embodiments, the elongate tubular body 102 and/or the overmold layer 120 can be formed with a thermoset composite material. As provided herein, thermoset composite materials can be formed from the polymerization and cross-linking of a thermoset precursor. Such thermoset precursors can include one or more liquid resin thermoset precursors. In one embodiment, liquid resin thermoset precursors include those resins in an A-stage of cure. Characteristics of resins in an A-stage of cure include those having a viscosity of 1,000 to 500,000 centipoises measured at 77° F. (Handbook of Plastics and Elastomers, Editor Charles A. Harper, 1975).

In the embodiments described herein, the liquid resin thermoset precursor that is selected from an unsaturated polyester, a polyurethane, an epoxy, an epoxy vinyl ester, a phenolic, a silicone, an alkyd, an allylic, a vinyl ester, a furan, a polyimide, a cyanate ester, a bismaleimide, a polybutadiene, and a polyetheramide. As will be appreciated, the thermoset precursor can be formed into the thermoset composite material by a polymerization reaction initiated by heat, pressure, catalysts, and/or ultraviolet light. In an additional embodiment, the liquid resin thermoset precursor can include a polymerizable material sold under the trade designator "K2MC™" from the Kurz-Kasch Company of Dayton, OH.

As will be appreciated, the thermoset composite material used in the embodiments of the present invention can include reinforcement members and/or additives such as fillers, fibers, curing agents, inhibitors, catalysts, and toughening agents (e.g., elastomers), among others, to achieve a desirable combination of physical, mechanical, and/or thermal properties. Reinforcement members can include woven and/or nonwoven fibrous materials. Reinforcement members can also include particulate materials. In various embodiments, types of reinforcement members can include, but are not limited to, glass fibers, including glass fiber variants, carbon fibers, synthetic fibers, natural fibers, metal fibers, and ceramic fibers. Other types of reinforcement members can include boron, carbon, flock, graphite, jute, sisal, whiskers, macerated fabrics, and aramid, among others.

Fillers include materials added to the matrix of the thermoset composite material to alter its physical, mechanical, thermal, or electrical properties. Fillers can include, but are not limited to, organic and inorganic materials, clays, silicates, mica, talcs, carbonates, asbestos fines and paper, among others. Some fillers can act as pigments, e.g., carbon black, chalk and titanium dioxide; while others such as graphite, molybdenum disulfide and PTFE can be used to impart lubricity. Other fillers can include metallic fillers such as lead or its oxides to increase specific gravity. Fillers having a powdered form can impart higher thermal conductivity, e.g., powdered metals such as aluminum, copper, and bronze, among others.

In some embodiments, an additive can be provided that conducts electrical charges. For example, as discussed herein, the fuel rail 100 can deliver fluid such as a flammable liquid hydrocarbon mixture used as a fuel (e.g., diesel fuel or gasoline for passenger automobiles) to various components of the fuel rail. As the fuel flows through the lumen of the elongate tubular body, electrical charges can accumulate throughout the length of elongate tubular body. Providing an additive that conducts electrical charges can help to prevent such electrical charges from accumulating in the fuel rail.

Figures 2A, 2B:
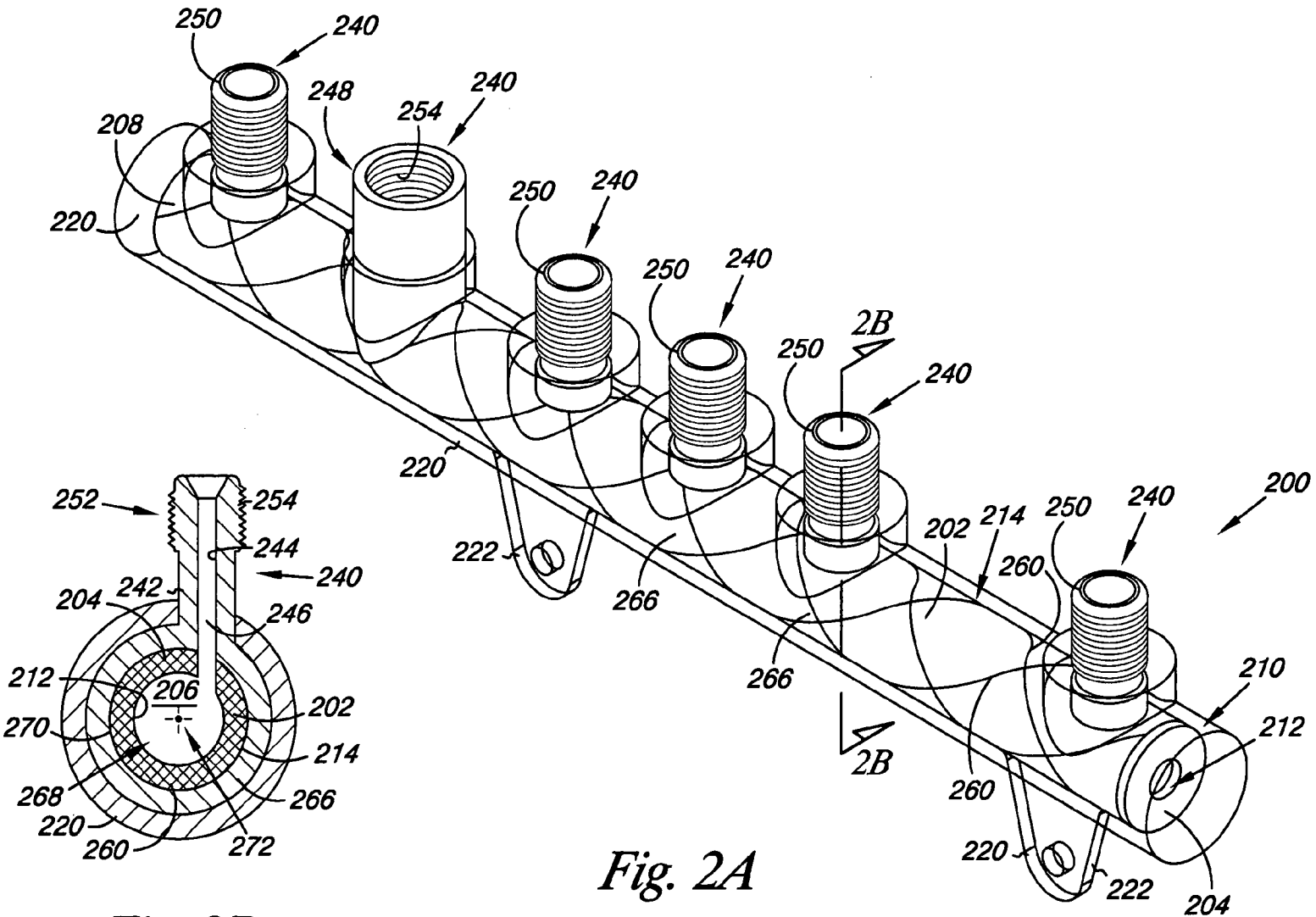
FIG. 2A illustrates an embodiment of a fuel of the present invention.
FIG. 2B is a cross-sectional view of the fuel rail of FIG. 2A take along lines 2B-2B.

FIGS. 2A and 2B provide an illustration of a fuel rail 200 in which the elongate tubular body 202 includes reinforcement members 260. As illustrated, the reinforcement members 260 can provide a laminate composition of the reinforcement members 260 impregnated with the thermoset composite material to provide a bonded fiber composite. In one example, a suitable source of the thermoset composite material for impregnating the reinforcement members 260 includes those sold under the trade designator "UF3369 Resin System" from Composite Resources, Inc. of Rock Hill S.C.

In one embodiment, the reinforcement members 260 are oriented to provide strength and stability to the reinforced thermoset composite material. Examples of such orientation include, but are not limited to, winding angles of seventy (70) to ninety (90) degrees relative the elongate axis of the elongate tubular body 260. So, for example, the reinforcement members 260 can be configured to radially encircle the elongate tubular body 202 so as to provide additional hoop strength to the elongate tubular body 202 and the fuel rail 200.

The reinforcement members 260 of the fuel rail 200 can include a number of configurations. For example, the reinforcement members 260 can be wound of a continuous filament and/or weaving, and/or include the reinforcement members 260 in a chopped configuration. Weaving patterns for the continuous filament can include, but are not limited to, plain weave, basket weave, leno weave, twill weave crowfoot satin weaves, and/or long shaft satin weaves. When wound to form the elongate tubular body 202, or other component of the fuel rail 200, the continuous filament can be orientated to have helical, circumferential, longitudinal, or a combination of patterns.

In addition, the reinforcement members 260 can have either a uniform or non-uniform density along the length of the elongate tubular body 202. For example, the reinforcement members 260 can be wound at a first density (weight of filaments per defined volume) in one or more of a first region, and a second density different than the first density in one or more of a second region of the elongate tubular body 202. In addition, different weaving and/or winding patterns for the reinforcement members 260 along the length of the elongate tubular body 202 can also be used to obtain application specific goals for the fuel rail 200.

As discussed more fully herein, the reinforcement members 260 can be impregnated with a thermoset precursor prior to being wound on a mandrel. Once wound, the thermoset precursor impregnated into the reinforcement members 260 can then be cured. Alternatively, the reinforcement members 260 can be wound on a mandrel, placed into a mold into which the thermoset precursor is injected to wet the reinforcement members 260 and fill the mold. The thermoset precursor can then be fully or partially cured prior to further processing. The reinforcement members 260 can also include chemical coupling agents to improve thermoset precursor penetration (improved wettability) and interfacial bonding between a thermoset composite material and fiber surface.

In one embodiment, the elongate tubular body 202 has a burst strength of not less than 160,000 pounds per square inch (PSI), as assessed according to CompositePro™ software package available from Peak Composite Innovations, LLC of Arvada, Colo. In an additional embodiment, the elongate tubular body 202 has a burst strength of at least 300 to 32,000 PSI, as assessed according to CompositePro™ software package available from Peak Composite Innovations, LLC of Arvada, Colo. As will be appreciated, the burst strength of the elongate tubular body 202 can be altered depending upon the thickness of the wall 204, the thermoset composite material used, the type and weave of reinforcement members 260 (discussed below) used, or whether reinforcement members 260 were used.

FIGS. 2A and 2B also provide an illustration of a collar 266 coupled to the connector 252 of the pressure port 240. In one embodiment, the collar 266 and the connector 252 are integral. For example, the collar 266 and the connector 252 of the pressure port 240 can be formed as a single piece (e.g., formed in a single casting). As illustrated, the collar 266 includes an opening 268 that allows the collar 266 to be positioned over and radially encircle the elongate tubular body 202.

As will be appreciated, with the collar 266 in position over the elongate tubular body 202 a distance 270 can exist between the opening 268 of the collar 266 and outer surface 212 of the elongate tubular body 202. In one embodiment, the void defined by the distance 270 can be filled with the overmold layer 220. The overmold layer 220 then serves to secure collar 266, and thus the pressure port 240, to the elongate tubular body 202. In other words, the material used for the overmold layer 220 helps to lock the collar 266, and thus the pressure port 240, to the elongate tubular body 202 by creating a bond between the surface defining the opening 268 and a portion of the outer surface 214 of the elongate tubular body 202.

Figures 3A, 3B:
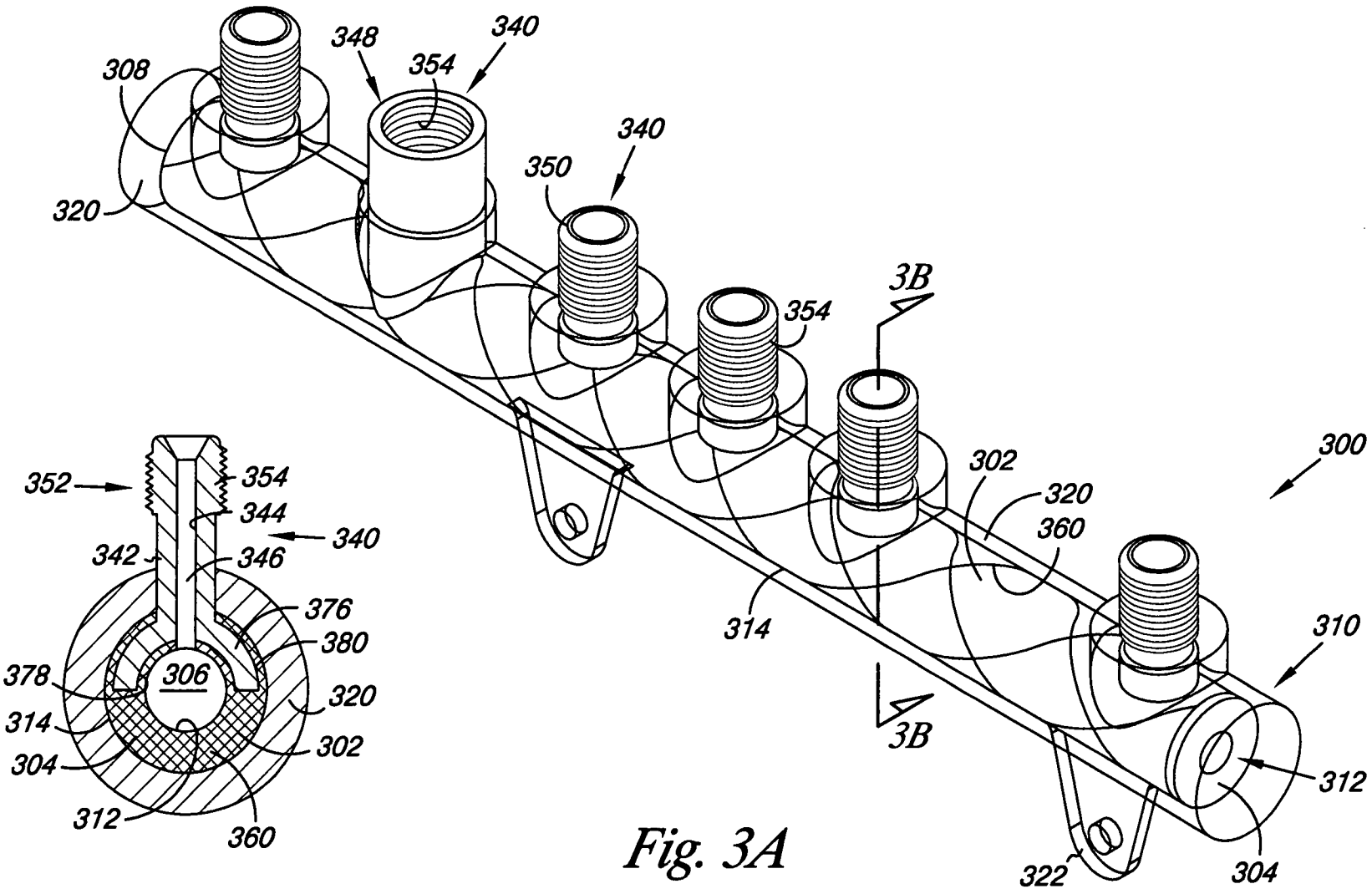
FIG. 3A illustrates an embodiment of a fuel of the present invention.
FIG. 3B is a cross-sectional view of the fuel rail of FIG. 3A take along lines 3B-3B.

In an additional embodiment, the collar 266 of the pressure port 240 can be integrated within the reinforcement members 260 so as to embed at least a portion of the collar 266 in the wall 204 of the elongate tubular body 202, as will be more fully illustrated herein with respect to FIGS. 3A and 3B.

In various embodiments of the present disclosure, the pressure port 240 can be formed from various materials, including, but not limited to, metal, metal alloy, ceramic, and/or a polymer. Pressure ports being formed of a polymer can include those formed from a thermoset and/or a thermoplastic, as are known and/or described herein. Generally, the pressure port 240 can be constructed of a material that is chemically inert and/or resistant to the fuel being delivered by the fuel injector system.

FIG. 2B further illustrates an embodiment of the fuel rail 200 in which the lumen 246 of the pressure port 240 extends from a lateral position relative the center axis 272 of the lumen 206. In one embodiment, this lateral position for the lumen 246 may allow for high pressure fluid flow having less turbulence, and thus less likelihood of cavitation.

In addition, the pressure ports 240 can be configured along the elongate body 202 such that the lumens 246 extend from the essentially the same relative lateral position along the length of the elongate tubular body 202. Alternatively, the pressure ports 240 can be configured such that the lumens 246 extend from different relative lateral position as discussed herein (e.g., one or more of a first of the lumen 246 extends from a first side of the lumen 206 relative the center axis 272 while one or more of a second of the lumen 246 extends from a second side of the lumen 206 relative the center axis 272).

FIGS. 3A and 3B illustrate an embodiment of the fuel rail 300 in which the pressure port 340 includes a shoulder 376 connected to the connector 352. In one embodiment, the shoulder 376 and the connector 352 are integral. For example, the shoulder 376 and the connector 352 of the pressure port 340 can be formed as a single piece (e.g., formed in a single casting). As illustrated, the shoulder 376 includes a first surface 378 and a second surface 380 opposite thereto, where the surfaces 378 and 380 extend from the connector 352 in a radial arc that generally corresponds to the radial arc of the wall 304. In other words, the surfaces 378 and 380 of the shoulder 376 mimic the geometric shape of the wall 304.

As illustrated in FIG. 3B, the shoulder 376 can be integrated within the reinforcement members 360 of the elongate tubular body 302. In this embodiment, the reinforcement members 360 are positioned around the first surface 378 and the second surface 380 of the shoulder 376. Alternatively, the first surface 378 can form a portion of lumen 306 of the elongate tubular body 302, with the reinforcement members 360 positioned around the second surface 380 of the shoulder 376. As will be appreciated, the shoulder 376 can extend to a predetermined radial distance around the wall 304 and/or axially along the length of the elongate tubular body 302. In addition, an overmold layer 320 need not be used with the embodiment illustrated in FIGS. 3A and 3B.

Figures 4A, 4B:
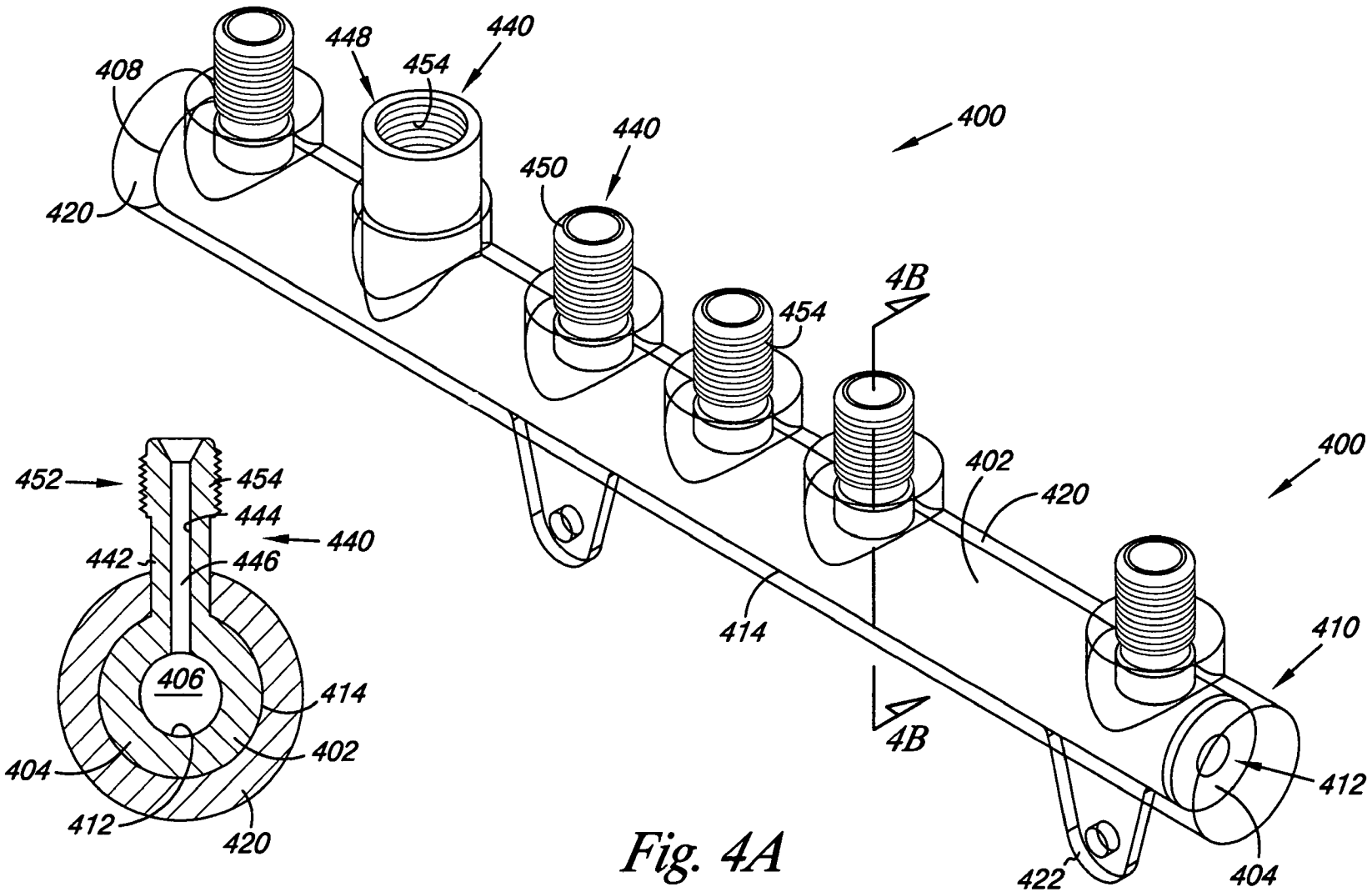
FIG. 4A illustrates an embodiment of a fuel of the present invention.
FIG. 4B is a cross-sectional view of the fuel rail of FIG. 4A take along lines 4B-4B.

FIGS. 4A and 4B provide an additional embodiment of a fuel rail 400 in which the elongate tubular body 402 and the pressure port 440 are formed with the thermoset composite material. So, as will be discussed more fully herein, the elongate tubular body 402 and the pressure port 440 can be integrally formed during a molding process in which the thermoset precursor is injected into a mold having surfaces that define the elongate tubular body 402 and the pressure port 440.

As will be appreciated, the connector 452 (e.g., the threads) can be formed in situ during the molding process. In an additional embodiment, the threads could be cut to form the connector 452 by a grinding or milling operation. Alternatively, the connector 452 can be coupled to the pressure port 440 in a post molding operation. For example, the connector 452 could be configured as a collar having externally projecting threads, where the collar is secured to the pressure port 440 for making a releasable coupling to other components of the fuel injection system. In one embodiment, the collar could be mechanically or chemically adhered to the pressure port 440.

In an additional embodiment, the fuel rail 400 can further include an overmold layer 420 formed with the thermoset composite material. As will be appreciated, the elongate tubular body 402, the pressure ports 440, and the overmold layer 420 could all be formed during the same molding procedure. In other words, these components (e.g., elongate tubular body 402, the pressure ports 440, and the overmold layer 420) are all formed at the same time inside the same mold using the same thermoset composite material. Alternatively, different combinations of the components could be formed simultaneously or separately. For example, the elongate tubular body 402 and the pressure ports 440 could be formed in one molding operation from a first thermoset composite material. The overmold layer 420 of a second thermoset composite material could then be added in a separate molding operation. Alternatively, an overmold layer 420 need not be used with the embodiment illustrated in FIGS. 4A and 4B.

Figure 5A:
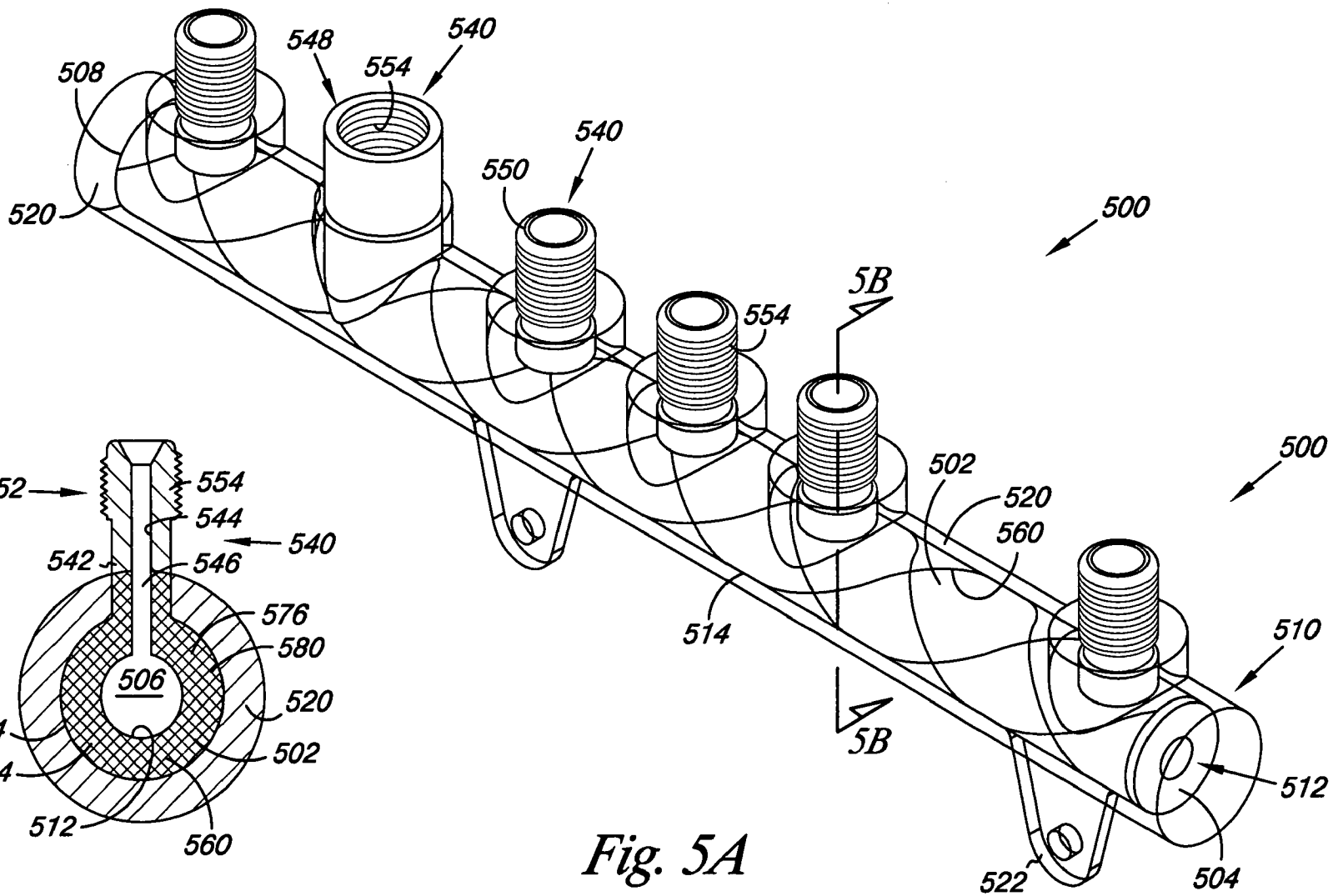
FIG. 5A illustrates an embodiment of a fuel of the present invention.
Figure 5B:
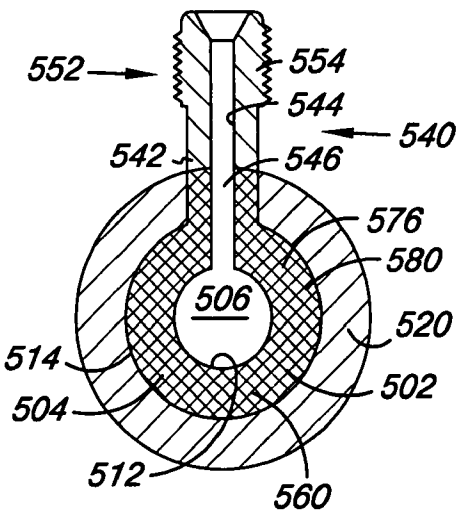
FIG. 5B is a cross-sectional view of the fuel rail of FIG. 5A take along lines 5B-5B.

FIGS. 5A and 5B provide an additional embodiment of a fuel rail 500 in which the elongate tubular body 502 and the pressure port 540 are formed with both the reinforcement members 560 and the thermoset composite material. So, as will be discussed more fully herein, the elongate tubular body 502 and the pressure port 540 can include reinforcement members 560 to provide a laminate composition, as discussed herein. As illustrated, the reinforcement members 560 can be configured to radially encircle both the elongate tubular body 502 and the pressure ports 540. The thermoset composite material can then be used to create an integrally formed bonded fiber composite.

As will be appreciated, the connector 552 (e.g., the threads) can be formed as discussed herein (e.g., as described with respect to FIGS. 4A and 4B). In an additional embodiment, the fuel rail 500 can further include an overmold layer 520 formed with a thermoset composite material. As will be appreciated, the elongate tubular body 502, the pressure ports 540, and the overmold layer 520 could all be formed during the same molding procedure. In other words, these components (e.g., elongate tubular body 502, the pressure ports 540, and the overmold layer 520) are all formed at the same time inside the same mold using the same thermoset composite material. Alternatively, different combinations of the components could be formed simultaneously or separately. For example, the elongate tubular body 502 and the pressure ports 540 could be formed in one molding operation from a first thermoset composite material. The overmold layer 520 of a second thermoset composite material could then be added in a separate molding operation. Alternatively, an overmold layer 520 need not be used with the embodiment illustrated in FIGS. 5A and 5B.

Figure 6:
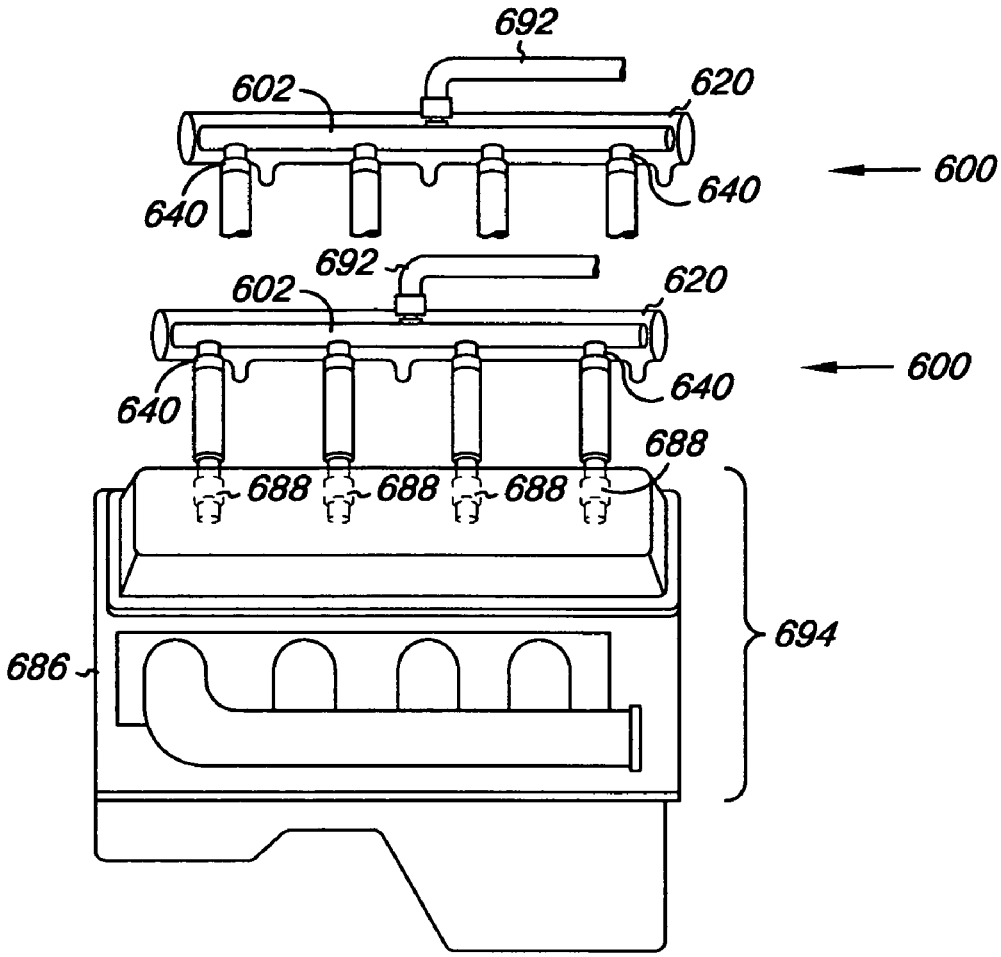
FIG. 6 illustrates an example of an internal combustion engine that includes an embodiment of the fuel rail of the present invention.

FIG. 6 illustrates an example of a device in which the fuel rail embodiments described herein can be used. As the reader will appreciate, a device employing a fuel rail can include an engine in which the fuel rail can be attached. For ease of illustration, the example embodiment provided in FIG. 6 is a description of an internal combustion engine 686 incorporating a number of fuel rails as the same have been described herein. Embodiments of the invention, however, are not limited to this illustrative example.

Further, those of ordinary skill in the art will appreciate that, although two fuel rails for accommodating an eight (8) cylinder engine are shown in FIG. 6, embodiments of the present invention can include fuel rails for accommodating an engine having a different number of cylinders. Additionally, for reasons of simplicity, the engine illustrated in FIG. 6 does not show many of the parts normally associated with such engines, but rather is meant to illustrate an application for the fuel rails. The fuel rails illustrated in FIG. 6 include the returnless type fuel rail. In various embodiments however, return type fuel rails can be used.

As illustrated in FIG. 6, the engine 686 includes two fuel rails 600. Each fuel rail 600 includes an elongate tubular body, pressure ports 640 and an overmold layer 620. As shown in FIG. 6, fuel injectors 688 for injecting fuel into individual cylinders. The fuel injectors 688 can be releasably coupled to pressure ports 640. Each fuel injector may alto include male or female supports for coupling to the pressure ports 640, depending on the configuration of each pressure port, e.g., male and female threaded members.

The engine 686 also includes a fuel line 692 for conveying fuel between the fuel rail and the fuel tank. The engine 686 further includes a housing 694. The housing 694 of the engine includes an intake manifold, among other things, for coupling the fuel injectors 688 to the engine 686, such that the fuel injectors can deliver fuel to the engine 686.

Methods and processes for forming the various components of the fuel rail described herein are provided as non-limiting examples of the present invention. As will be appreciated, a variety of molding processes exist that can be used to form the components of the fuel rail. Examples of such molding processes can include dip molding, hand lay-up, spray up, resin transfer molding, pultrusion, compression molding, transfer molding, and injection molding, among others.

As discussed herein, the elongate tubular body of the fuel rail can be formed with or without reinforcement members. When the elongate tubular body is formed with reinforcement members, the reinforcement members are wound around a mandrel. The winding configuration and the configuration of the reinforcement member can be as discussed herein. As will be appreciated the mandrel can define the shape of the lumen of the elongate tubular body.

In an additional embodiment, the reinforcement members can either be impregnated with the thermoset precursor (e.g., a thermoset precursor in either an A-stage of cure or a B-stage of cure), as discussed herein, or not be impregnated. The reinforcement members can be continuously wound under tension around a cylindrical, conical, or other shape mandrel a specific pattern. As discussed, the orientation of the members can be helical, circumferential, longitudinal, or a combination of patterns. For helical winding, the mandrel rotates continuously while a feed carriage dispensing the reinforcement members moves back and forth at a controlled speed that determines the helical angle.

The mandrel with the reinforcement members can then be mounted in a mold half mounted on movable platen, which when closed centers the mandrel within the mold cavity. Once the mold closes, heat and pressure can be applied to cure the thermoset precursor impregnated reinforcement members to form the elongate tubular body. In one embodiment, curing temperatures are typically below 160° C. (e.g., 125° C.). A post cure process can also be used. After curing, the elongate tubular body can be removed from the mandrel and machined, as discussed below.

In an alternative embodiment, non-impregnated reinforcement members can be wound on the mandrel as discussed herein. The mandrel can then be mounted in the mold. Low-viscosity thermoset precursor and catalyst (optional) can then be injected into the mold under low pressure to wet the reinforcement members and to fill the mold in a resin transfer molding process. Heat and pressure can then be applied to cure the thermoset precursor impregnated reinforcement members to form the elongate tubular body. In one embodiment, curing temperatures are typically below 160° C. A post cure process can also be used. After curing, the elongate tubular body can be removed from the mandrel and machined, as discussed below.

The cured elongate tubular body can then undergo one or more post cure processes. For example, the outer surface of the elongate tubular body can be centerless ground to provide an outer diameter of a predetermined dimension and surface preparation. For example, the predetermined dimension can allow for the opening of the pressure port collar to slide over the elongate tubular body. In addition, the lumen of the elongate tubular body can be bored (e.g., gun bored or drilled) to provide a smooth surface so as to reduce the formation of turbulent fluid flow through the lumen of the elongate tubular body.

In alternative embodiment, the wound reinforcement members and the thermoset precursor on the mandrel can be left partially cured (i.e., "wet"). Regardless of the cure state (i.e., cured or "wet"), the elongate tubular body can then receive the pressure ports. As discussed herein, the pressure ports can include the collar having the opening that can receive and encircle the elongate tubular body. The wound reinforcement members on the mandrel with the thermoset composite material (either cured or "wet") with the pressure ports can then be placed into a mold for receiving the overmold layer.

In one embodiment, the pressure ports can be registered in the mold at predetermined locations along the elongate body. The mold can then be closed and the thermoset precursor that will form the overmold layer injected into the mold. As discussed herein, the thermoset precursor for the overmold layer flows into the distance between the opening of the collar and outer surface of the elongate tubular body. Once cured, the thermoset composite material of the overmold layer locks the pressure port in place along the elongate tubular body. The flash from the overmold layer can then be removed from the fuel rail.

In addition to deflashing, the lumen of the pressure port is also completed and/or formed. For example, once the overmold layer is cured, a drilling process can be used to form a lumen through both the pressure port and the wall of the elongate tubular body so as to provide fluid communication between the lumen of the elongate tubular body and a lumen of the pressure port. Alternatively, the pressure port may have at least a preexisting portion of the lumen extending there through, where the remaining portion of the lumen can be formed (e.g., drilled) through the wall of the elongate tubular body so as to provide fluid communication between the lumen of the elongate tubular body and a lumen of the pressure port.

In an alternative embodiment, the pressure port can include a shoulder that is either partially or completely integrated within the reinforcement members of the elongate tubular body. For example, reinforcement members (impregnated and/or not impregnated with thermoset precursor) are wound under tension around the mandrel, as discussed herein. After a predetermined amount of the reinforcement members have been wound (or a predetermine thickness of the reinforcement members has been reached), the winding process is temporarily stopped. The pressure ports are then positioned along the developing elongate tubular body at predetermined locations.

Once the pressure ports are positioned, the winding of the reinforcement members continues to completely integrate the shoulder of the pressure port into the wall of the elongate tubular body. The elongate tubular body and the pressure ports can then be processed as discussed herein to form the fuel rail.

In an additional embodiment, the pressure ports can be positioned along the mandrel prior to the winding of the reinforcement members. Once in position, the reinforcement members (impregnated and/or not impregnated with thermoset precursor) are wound under tension around the mandrel and the pressure port shoulders, as discussed herein. The elongate tubular body and the pressure ports can then be processed as discussed herein to form the fuel rail.

Figure 7:
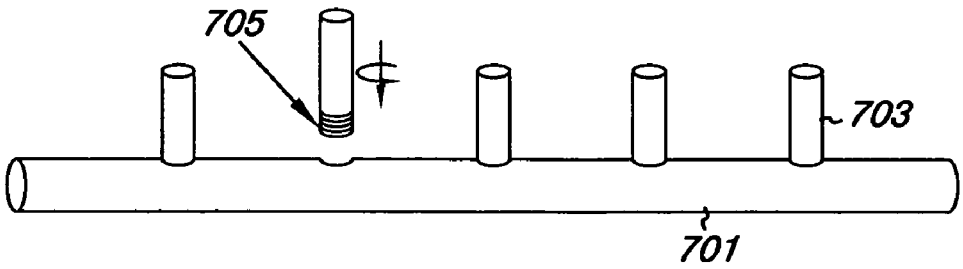
FIG. 7 illustrates an embodiment of a mandrel which can be used to form a fuel rail.

As discussed herein, the fuel rail can also be formed substantially from the thermoset composite material, as discussed generally with respect to FIG. 4. For example, FIG. 7 illustrates an embodiment of a mandrel 701, which defines the lumen of the elongate tubular body, which includes mandrel extensions 703, which define the lumen of the pressure ports. In one embodiment, the mandrel 701 having the mandrel extension 703 can be placed into a mold having surfaces defining at least the elongate tubular body and the pressure ports.

The thermoset precursor (e.g., low-viscosity thermoset precursor) and catalyst (optional) can then be injected into the mold under low pressure to fill the mold. Heat and pressure can then be applied to cure the thermoset precursor to form the elongate tubular body and the pressure ports. A post cure process can also be used. After curing, the mandrel 701 and the extension mandrel 703 can be removed (e.g., the extension mandrels are releasably attached to the mandrel, such as by a threaded connection 705) from the elongate tubular body and the pressure ports and machined, as discussed herein.

In an additional embodiment, the mandrel 701 and mandrel extensions 703 can have reinforcement members wound around the mandrel 701 and/or the extension mandrels 703. As discussed herein, the reinforcement members can either be impregnated with the thermoset precursor, or not impregnated. The mandrel 701 and extension mandrels 703 can then be mounted and properly positioned within the mold cavity. Depending upon the state of the reinforcement members, the mold can then apply heat and pressure to cure the thermoset precursor impregnated reinforcement members to form the elongate tubular body and the pressure ports.

Alternatively, the low-viscosity thermoset precursor and catalyst (optional) can be injected into the mold under low pressure to wet the reinforcement members and to fill the mold in the resin transfer molding process. Heat and pressure can then be applied to cure the thermoset precursor impregnated reinforcement members to form the elongate tubular body and the pressure ports. A post cure process can also be used. After curing, the elongate tubular body can be removed from the mandrel and machined, as discussed herein. An overmold layer can then be added to the resulting structure, as discussed herein.

In an additional embodiment, a mandrel and pressure ports (e.g., with collar and/or with shoulder) can be positioned within a mold. The thermoset precursor (e.g., low-viscosity thermoset precursor) and catalyst (optional) can then be injected into the mold under low pressure to fill the mold. Heat and pressure can then be applied to cure the thermoset precursor to form the elongate tubular body. A post cure process can also be used. After curing, the mandrel can be removed from the elongate tubular body, and the pressure ports and the elongate tubular body machined (e.g., drilled and finished), as discussed herein. An overmold layer can then be added to the resulting structure, as discussed herein.

While the present invention has been shown and described in detail above, it will be clear to the person skilled in the art that changes and modifications may be made without departing from the spirit and scope of the invention. For example, a tubular sleeve could be used in place of the mandrel, where the tubular sleeve remains in the finished fuel rail. As such, that which is set forth in the foregoing description and accompanying drawings is offered by way of illustration only and not as a limitation. The actual scope of the invention is intended to be defined by the following claims, along with the full range of equivalents to which such claims are entitled.

In addition, one of ordinary skill in the art will appreciate upon reading and understanding this disclosure that other variations for the invention described herein can be included within the scope of the present invention. For example, the fuel rail can be used in any internal combustion type engine.

What is claimed is:

1. A fuel rail, comprising:

an elongate tubular body having a wall defining a lumen, the elongate tubular body formed with a thermoset composite material; and a pressure port having a lumen in fluid communication with the lumen of the elongate tubular body, where the pressure port includes a collar extending at least partially around the elongate tubular body; and an overmold layer around the collar and the elongate tubular body to secure the collar of the pressure port to the elongate tubular body.

2. The fuel rail of claim 1, wherein the thermoset composite material is formed from a liquid resin thermoset precursor that is selected from an unsaturated polyester, a polyurethane, an epoxy, a phenolic, a silicone, an alkyd, an allylic, a vinyl ester, a furan, a polyimide, a cyanate ester, a bismaleimide, a polybutadiene, and a polyetheramide.

3. The fuel rail of claim 1, wherein the elongate tubular body includes reinforcement member impregnated with the thermoset composite material.

4. The fuel rail of claim 3, wherein the collar of the pressure port extends at least partially between the reinforcement member of the elongate tubular body.

5. The fuel rail of claim 1, wherein the elongate tubular body includes reinforcement member impregnated with the thermoset composite material.

6. The fuel rail of claim 5, wherein the pressure port includes reinforcement member impregnated with the thermoset composite material.

7. The fuel rail of claim 5, wherein the elongate tubular body has a burst strength of not less than 160,000 pounds per square inch (PSI).

8. The fuel rail of claim 1, wherein the pressure port includes a collar having a surface defining at least part the lumen of the elongate tubular body.

9. The fuel rail of claim 8, wherein the elongate tubular body includes reinforcement member wound over at least a portion of the collar, the reinforcement member impregnated with the thermoset composite material.

10. A fuel rail, comprising:

an elongate tubular body having a wall defining a lumen, the elongate tubular body formed with reinforcement member impregnated with a thermoset composite material;

a pressure port having a lumen and a collar, the collar extending at least partially around the elongate tubular body and the lumen in fluid communication with the lumen of the elongate tubular body; and an overmold layer around the collar and the elongate tubular body.

11. The fuel rail of claim 10, wherein the overmold layer is a thermoset composite material that secures the collar of the pressure port to the elongate tubular body.

12. The fuel rail of claim 10, wherein the collar of the pressure port extends at least partially between the reinforcement member of the elongate tubular body.

13. The fuel rail of claim 10, wherein the collar of the pressure port includes a surface defining at least part the lumen of the elongate tubular body.

14. The fuel rail of claim 13, wherein the reinforcement member is wound over at least a portion of the collar.

15. The fuel rail of claim 10, wherein the thermoset composite material is formed from a liquid resin thermoset precursor having a viscosity of 1,000 to 500,000 centipoises.

16. A method for forming a fuel rail, comprising:

forming an elongate tubular body having a wall defining a lumen with a thermoset composite material;

coupling a pressure port to the elongate tubular body;

providing the pressure port over the elongate tubular body;

coupling the pressure port to the elongate tubular body with a thermoset composite material overmold; and providing for fluid communication between the lumen of the elongate tubular body and a lumen of the pressure port.

17. The method of claim 16, wherein coupling the pressure port includes integrally forming the pressure port and the elongate tubular body from the thermoset composite material.

18. The method of claim 17, including providing a reinforcement member within the wall of the elongate tubular body and a wall of the pressure port.

19. The method of claim 16, including:

providing a reinforcement member within the wall of the elongate tubular body;

positioning a collar of the pressure port over the elongate tubular body; and coupling the collar of the pressure port to the elongate tubular body with a thermoset composite material overmold.

20. The method of claim 16, wherein forming an elongate tubular body includes:

winding reinforcement members over at least a portion of a collar of the pressure port; and curing the thermoset composite material to form the elongate tubular body.

21. The method of claim 16, wherein providing for fluid communication include drilling an opening through the wall of the elongate tubular body to provide fluid communication between the lumen of the elongate tubular body and the lumen of the pressure port.

22. The method of claim 16, wherein forming the elongate tubular body includes forming the elongate tubular body with a resin transfer molding process.

23. The method of claim 16, including over molding the elongate tubular body and at least a portion of the pressure port with a liquid resin thermoset; and curing the liquid resin thermoset.

24. The fuel rail of claim 1, wherein the collar completely encircles the elongate tubular body.

25. The fuel rail of claim 1, wherein the overmold layer is formed of the thermoset composite material.

26. The fuel rail of claim 1, wherein the overmold layer is formed of a second thermoset composite material.

27. The fuel rail of claim 1, wherein the overmold layer includes a mounting structure for attaching the fuel rail to an engine.

28. The fuel rail of claim 1, wherein the wall defining the lumen of the elongate body includes a smooth surface as compared to an outer surface of the elongate tubular body.

* * * * *